US009555277B2

(12) United States Patent
Yeh

(10) Patent No.: US 9,555,277 B2
(45) Date of Patent: Jan. 31, 2017

(54) EXERCISE EQUIPMENT

(71) Applicant: PREVENTIVE MEDICAL HEALTH CARE CO., LTD., Taoyuan County (TW)

(72) Inventor: Ching-Yu Yeh, Taichung (TW)

(73) Assignee: PREVENTIVE MEDICAL HEALTH CARE CO., LTD., Taichung (TW)

( * ) Notice: Subject to any disclaimer, the term of this patent is extended or adjusted under 35 U.S.C. 154(b) by 44 days.

(21) Appl. No.: 14/185,938

(22) Filed: Feb. 21, 2014

(65) Prior Publication Data

US 2015/0080195 A1 Mar. 19, 2015

Related U.S. Application Data

(60) Provisional application No. 61/879,151, filed on Sep. 18, 2013.

(51) Int. Cl.
*A63B 21/00* (2006.01)
*A63B 21/012* (2006.01)
(Continued)

(52) U.S. Cl.
CPC ..... *A63B 21/012* (2013.01); *A63B 21/0051* (2013.01); *A63B 21/00069* (2013.01); *A63B 21/4034* (2015.10); *A63B 22/0046* (2013.01); *A63B 22/0056* (2013.01); *A63B 22/0076* (2013.01); *A63B 22/0605* (2013.01); *A63B 22/0664* (2013.01); *A63B 22/203* (2013.01); *A63B 23/03525* (2013.01); *A63B 23/03566* (2013.01); *A63B 23/1263* (2013.01); *A63B 2022/0079* (2013.01); *A63B 2022/0676* (2013.01); *A63B 2209/08* (2013.01)

(58) Field of Classification Search
CPC ..... A63B 21/00058; A63B 21/0069; A63B 21/00072
See application file for complete search history.

(56) References Cited

U.S. PATENT DOCUMENTS 4,258,913 A * 3/1981 Brentham ..... A63B 21/0083 482/112
4,620,620 A * 11/1986 Johnston ..... F16F 9/462 188/266.4
(Continued)

FOREIGN PATENT DOCUMENTS

CN 2325081 Y 6/1999
CN 2882692 Y 3/2007
(Continued)

OTHER PUBLICATIONS http://www.castlemetalseurope.com/blog/ferrous-nonferrous-metals-uses/, Jul. 31, 2012, last visited Jan. 5, 2016.*
(Continued)

*Primary Examiner* — Loan H Thanh
*Assistant Examiner* — Rae Fischer
(74) *Attorney, Agent, or Firm* — CKC & Partners Co., Ltd.

(57) ABSTRACT

An exercise equipment includes a base, an operating device and a magnetic resistance device. The operating device is movably disposed on the base. The magnetic resistance device is connected to the operating device and the base, wherein the magnetic resistance device is for providing a magnetic resistances in accordance with an operation of the operating device.

7 Claims, 20 Drawing Sheets

(51) Int. Cl.

| | |
|---|---|
| ***A63B 21/005*** | (2006.01) |
| ***A63B 22/00*** | (2006.01) |
| *A63B 22/06* | (2006.01) |
| *A63B 22/20* | (2006.01) |
| *A63B 23/035* | (2006.01) |
| *A63B 23/12* | (2006.01) |

(56) References Cited

U.S. PATENT DOCUMENTS

| | | | | |
|---|---|---|---|---|
| 4,621,620 | A * | 11/1986 | Anderson | A61H 1/0259 482/901 |
| 5,735,778 | A | 4/1998 | Piaget | |
| 7,762,963 | B2 * | 7/2010 | Ewing | A61H 1/024 482/907 |
| 7,985,168 | B2 * | 7/2011 | Reyes | A63B 21/00072 482/130 |

FOREIGN PATENT DOCUMENTS

| | | | |
|---|---|---|---|
| CN | 201727889 | U | 2/2011 |
| JP | 2002502942 | A | 1/2002 |
| JP | 2007290534 | A | 11/2007 |
| KR | 200334169 | Y1 | 11/2003 |
| KR | 100534035 | B1 | 11/2005 |
| KR | 100651259 | B1 | 11/2006 |
| KR | 1020110095681 | A | 8/2011 |
| KR | 2020130005625 | U | 9/2013 |
| TW | 368876 | U | 9/1999 |
| TW | M429493 | U | 5/2012 |
| TW | M458994 | U | 8/2013 |
| WO | 2011140432 | A1 | 11/2011 |

OTHER PUBLICATIONS http://www.castlemetalseurope.com/blog/ferrous-nonferrous-metals-uses/, Jul. 31, 2012, last visited 1/5/16.*

* cited by examiner

400

1200

EXERCISE EQUIPMENT

RELATED APPLICATIONS

This application claims priority to U.S. Provisional Patent Application No. 61/879,151, filed Sep. 18, 2013, which is herein incorporated by reference.

BACKGROUND

Technical Field

The present invention relates to an exercise equipment.

Description of Related Art

Exercise equipment make raining day and limited ground no longer be problems of doing exercise. With the increase demand for exercise equipment, various types of exercise equipment for training different parts of user's body are provided.

In general, user should overcome the resistance generated from the exercise equipment for training the shape of body. However, the resistance device provides the resistance by rub two components. Therefore, the resistance device of the exercise equipment usually be broken easily.

SUMMARY

According to one aspect of the present disclosure, an exercise equipment includes a base, a rail, an operating device and at least one magnetic resistance device. The rail is disposed on the base. The operating device is for driving along the rail. The magnetic resistance device is for providing a magnetic resistance in accordance with an operation of the operating device. The magnetic resistance device includes at least one first element and at least one second element. The second element is adjacent to the first element and linked up with the operating device, wherein a movement between the first element and the second element is provided for generating the magnetic resistance.

According to another aspect of the present disclosure, an exercise equipment includes a base, an operating device and a magnetic resistance device. The operating device is movably disposed on the base. The magnetic resistance device is connected to the operating device and the base, wherein the magnetic resistance device is for providing a magnetic resistances in accordance with an operation of the operating device.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
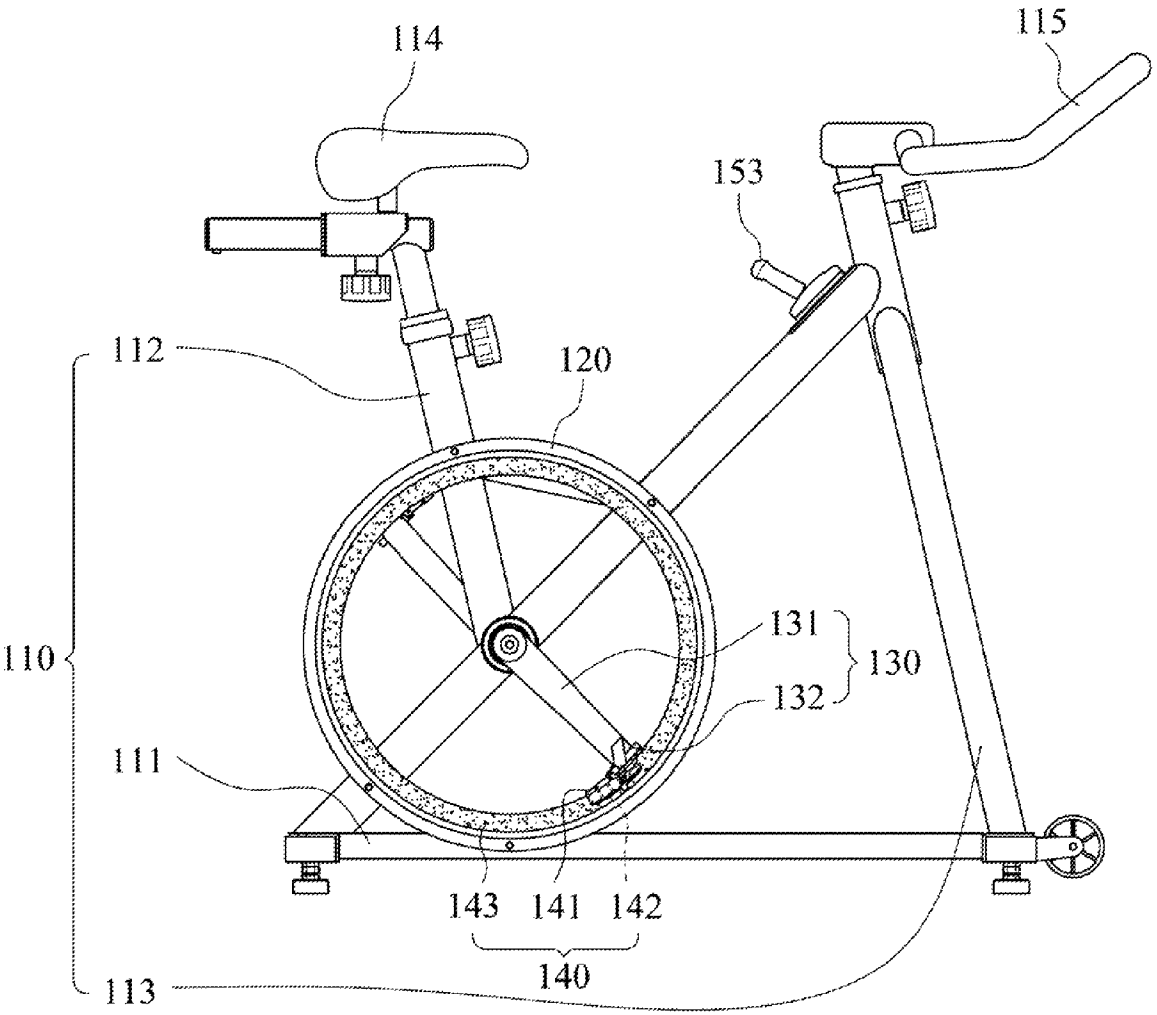
FIG. 1 shows a schematic view of an exercise equipment according to one embodiment of the present disclosure.

FIG. 1 shows a schematic view of an exercise equipment 100 according to one embodiment of the present disclosure. In FIG. 1, the exercise equipment 100 is an indoor bicycle, and includes a base 110, two rails 120, an operating device 130 and a magnetic resistance device 140.

In detail, the base 110 includes a bottom base 111, a first branch base 112 and a second branch base 113. One end of each of the first branch base 112 and the second branch base 113 are disposed on the bottom base 111. The other end of the first branch base 112 is connected to a seat base 114, and the other end of the second branch base 113 is connected to a handle 115. Each of the first branch base 112 and the second branch base 113 can be telescopic, that is, the height of each of the first branch base 112 and the second branch base 113 can be adjusted.

The rails 120 are disposed on two sides of the base 110. In FIG. 1, the rails 120 are circular-shaped, but is not limited thereto. (Only one rail is shown in FIG. 1)

The operating device 130 is for driving along the rails 120. In FIG. 1, the operating device 130 includes two driving cranks 131 and two pedals 132 (only one driving crank and one pedal be labelled in FIG. 1 and will be described herein). One end of the driving crank 131 is pivoted connected to the first branch base 112 of the base 110, the pedal 132 is connected to the other end of the driving crank 131. The user can step the pedals 132 for linking up the driving cranks 131 along the rails 120.

The magnetic resistance device 140 is for providing a magnetic resistances in accordance with an operation of the operating device 130. The magnetic resistance device 140 includes two first element disposed on each rail 120, and at least two second elements adjacent to each first element and linked up with the operating device 130 for moving along the rail 120, wherein a movement between the first element and the second element is provided for generating the magnetic resistance. In detail, the first elements of the magnetic resistance device 140 is conductive members 143, wherein the conductive member 143 can be made of copper, silver, aluminum or steel, but is not limited thereto. The second element of the magnetic resistance device 140 is a plurality of magnets 142. The magnetic resistance device 140 further includes two magnet bases 141. Each of the magnet bases 141 is connected to each driving crank 131, wherein the magnets 142 are located on the magnet bases 141. In FIG. 1, the magnets 142 are located on the inner wall of each magnet base 141 which adjacent to the side of the conductive member 143. When the user drive the driving cranks 131 via the pedals 132, the magnet bases 141 can be linked up and for providing the movement between the magnets 142 and the conductive member 143, so that the magnetic resistance can be generated. By directly generating the magnetic resistance, the exercise equipment 100 is an inertialess equipment, so that the security can be increased during using. Moreover, the magnets 142 are adjacent to the conductive member 143 for generating the magnetic resistance, so that the magnets 142 would not be directly contacted to the conductive member 143, and the magnetic resistance device 140 would not be broken easily.

Figure 2:
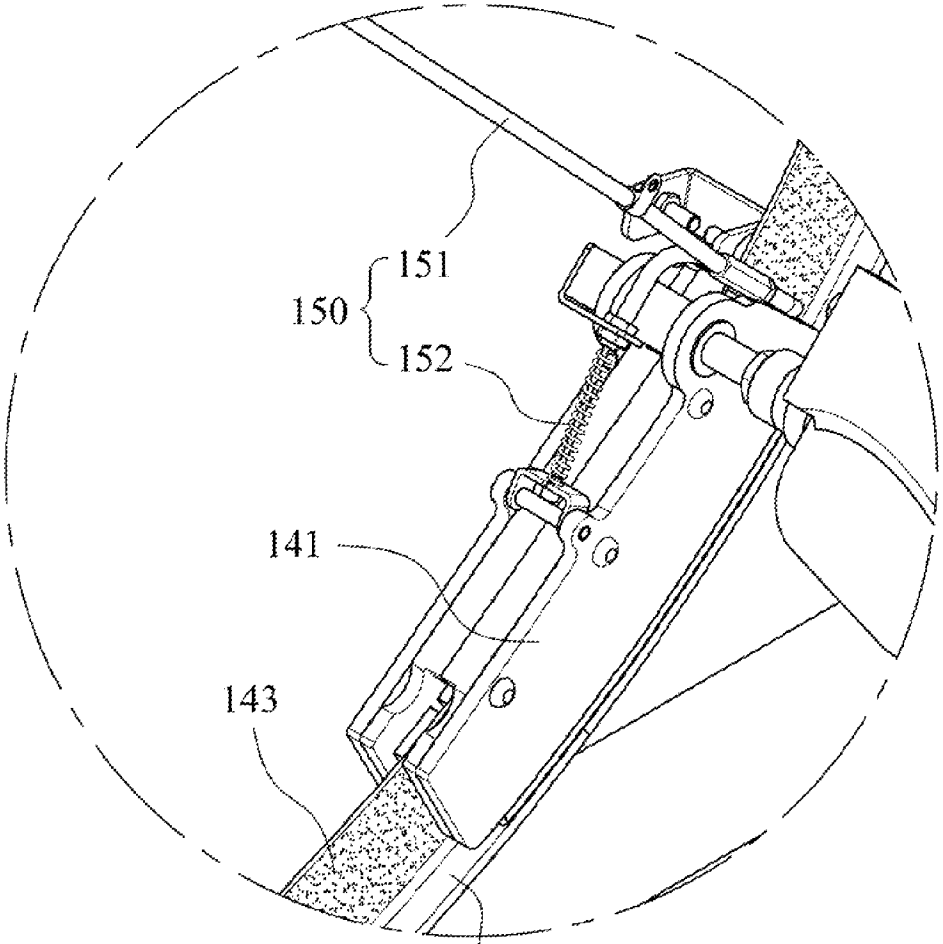
FIG. 2 shows an enlarged view of part of the exercise equipment of FIG. 1.

FIG. 2 shows an enlarged view of part of the exercise equipment 100 of FIG. 1. The exercise equipment 100 can include an adjusting device 150 for adjusting an adjacent area of the magnets 142 and the conductive members 143. In detail, the adjusting device 150 includes two forcing mechanisms 151, two restoring members 152 and a controlling member 153 (shown in FIG. 1). Each forcing mechanisms 151 is connected to and linked up with each magnet base 141 of the magnetic resistance device 140, and each restoring member 152 connected to each magnet base 141 for restoring the magnet base 141. The controlling member 153 is connected to the forcing mechanisms 151. The user can control the forcing mechanisms 151 via the controlling member 153. In this embodiment, the forcing mechanisms 151 is steel wire rope which can be electrically or mechanically driven via the controlling member 153, but is not limited thereto. The restoring members 152 is spring, but is not limited thereto. The controlling member 153 is disposed on the second branch base 113 of the base 110 and is adjacent to the handle 115, so that the user can easily operate the controlling member 153 during using the exercise equipment 100.

Figure 3A:
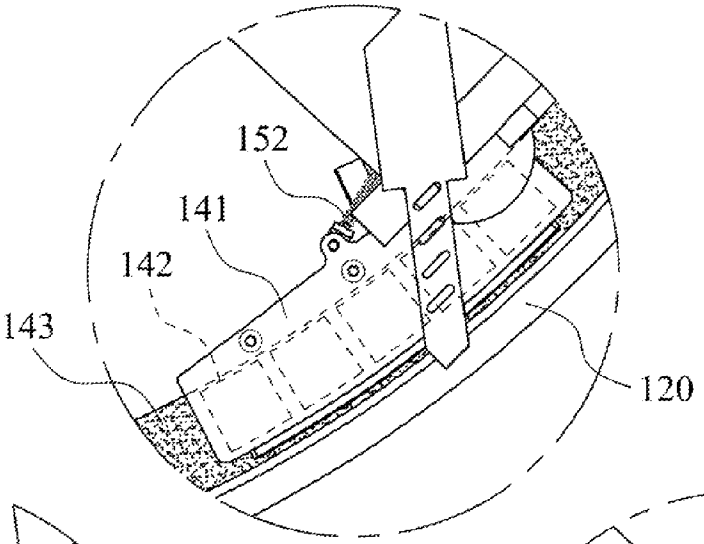
FIG. 3A is a schematic views of one using states between the magnets and the conductive member of the exercise equipment of FIG. 1.
Figure 3B:
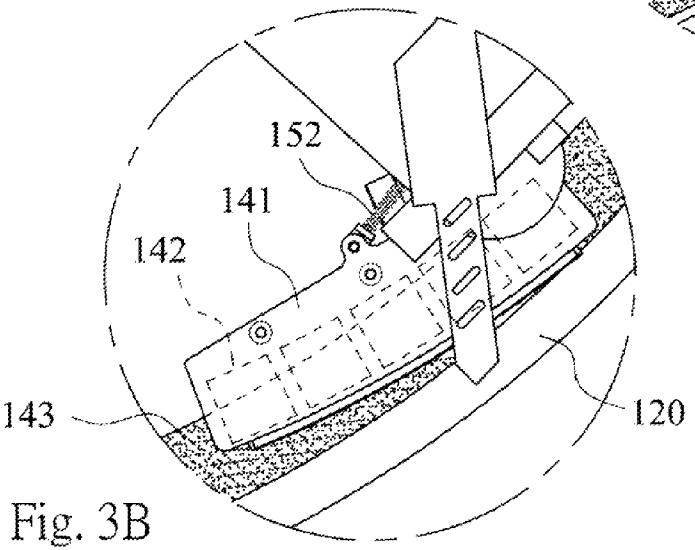
FIG. 3B is a schematic views of another using states between the magnets and the conductive member of the exercise equipment of FIG. 1.
Figure 3C:
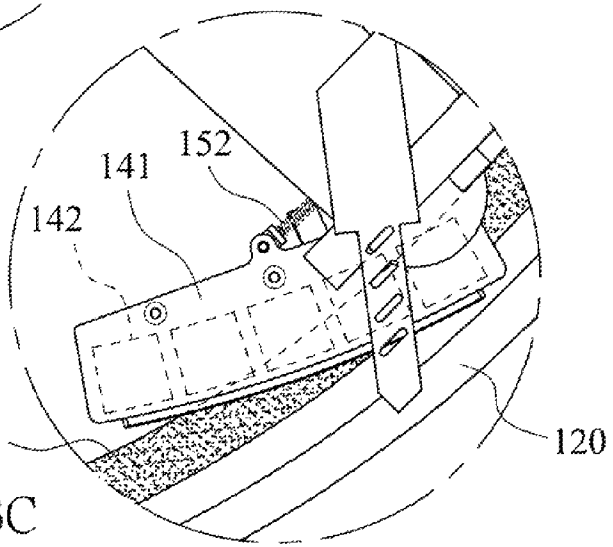
FIG. 3C is a schematic views of the other using states between the magnets and the conductive member of the exercise equipment of FIG. 1.

FIGS. 3A, 3B and 3C are schematic views of three using states between the magnets 142 and the conductive member 143 of the exercise equipment 100 of FIG. 1. In FIG. 3A, the adjacent area of the magnets 142 and the conductive members 143 is largest, so that the generated magnetic resistance is greatest. In FIG. 3B, the controlling member 153 is pulled by the user, and the forcing mechanisms 151 can pull the magnet bases 141 for adjusting the adjacent area of the magnets 142 and the conductive members 143. The adjacent area in FIG. 3B is smaller than the adjacent area in FIG. 3A, that is, the generated magnetic resistance from the using state in FIG. 3B is greater than the using state in FIG. 3A. In FIG. 3C, the controlling member 153 is further pulled by the user, and the magnetic resistance is further smaller than FIG. 3B. The using states from FIG. 3A to FIG. 3C, the restoring member 152 is compressed gradually. When the controlling member 153 releases the forcing mechanism 151, the restoring member 152 can restore the magnet base 141 back to the original position (as shown in FIG. 3A).

Figure 4:
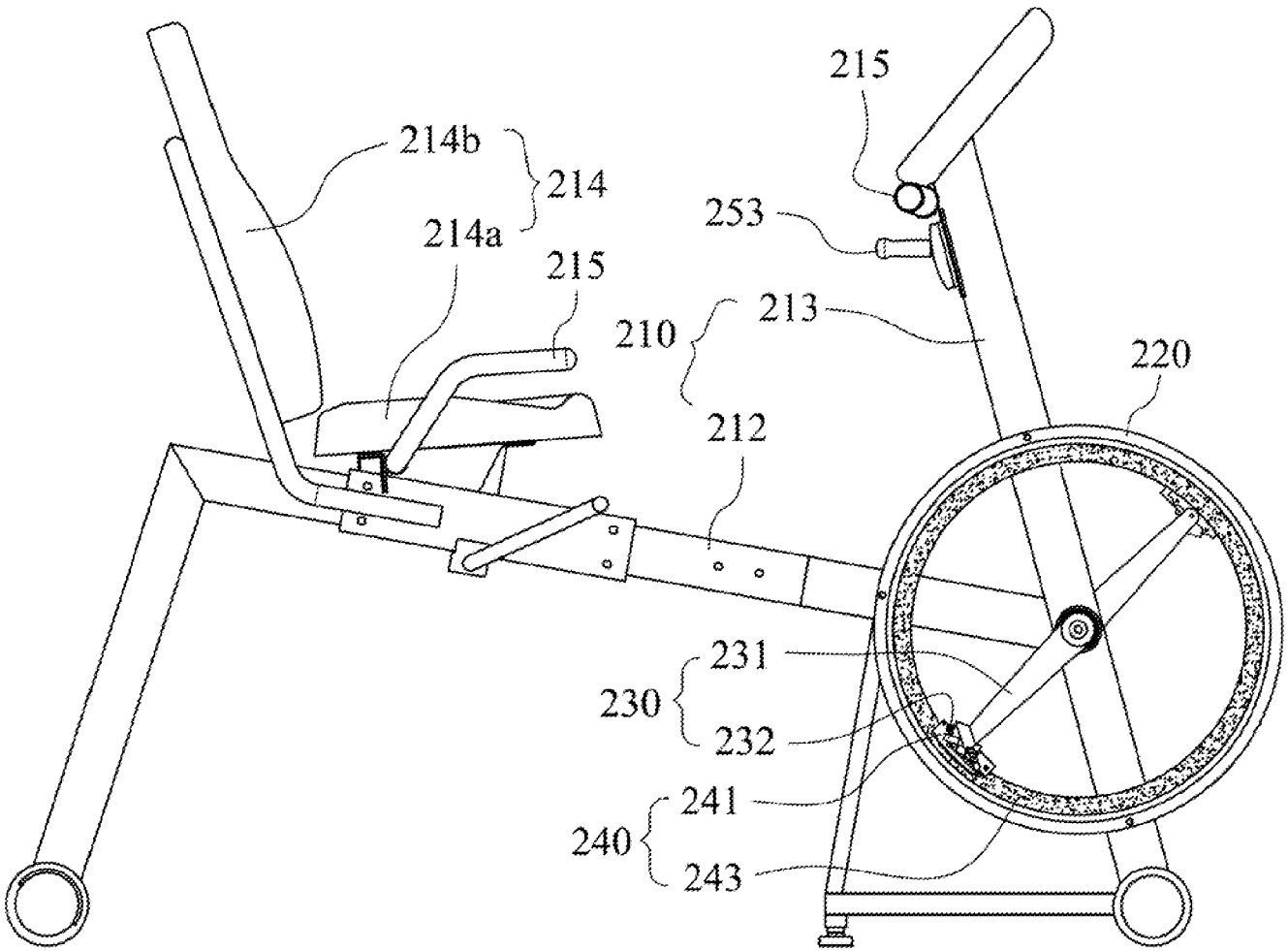
FIG. 4 shows a schematic view of an exercise equipment according to another embodiment of the present disclosure.

FIG. 4 shows a schematic view of an exercise equipment 200 according to another embodiment of the present disclosure. In FIG. 4, the base 210 includes a first branch base 212 and a second branch base 213, wherein the first branch base 212 is connected to the second branch base 213 along a cross direction. A seat base 214 is slidably connected on the first branch base 212, and the distance between the seat base 214 and the second branch base 213 is adjustable. Handles 215 can be disposed on two sides of the seat base 214 and the second branch base 213. In this embodiment, the seat base 214 includes a bottom seat base 214*a* and a back seat base 214*b*, so that the user can sit comfortably during using the exercise equipment 200.

In FIG. 4, two rails 220 are disposed on two sides of the second branch base 213. The operating device 230 also includes two driving cranks 231 and two pedals 232. The magnetic resistance device 240 includes two magnet bases 241, a plurality of magnets 242 and two conductive members 243. The connecting and operating relationships among the rails 220, the operating device 230 and the magnetic resistance device 240 are the same with the rails 120, the operating device 130 and the magnetic resistance device 140 in FIG. 1, and will not explain again herein.

Figure 5B:
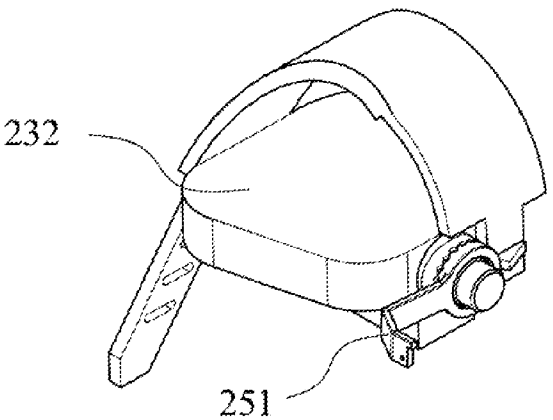
FIG. 5B is a schematic view of the pedals of the exercise equipment of FIG. 4.
Figure 5A:
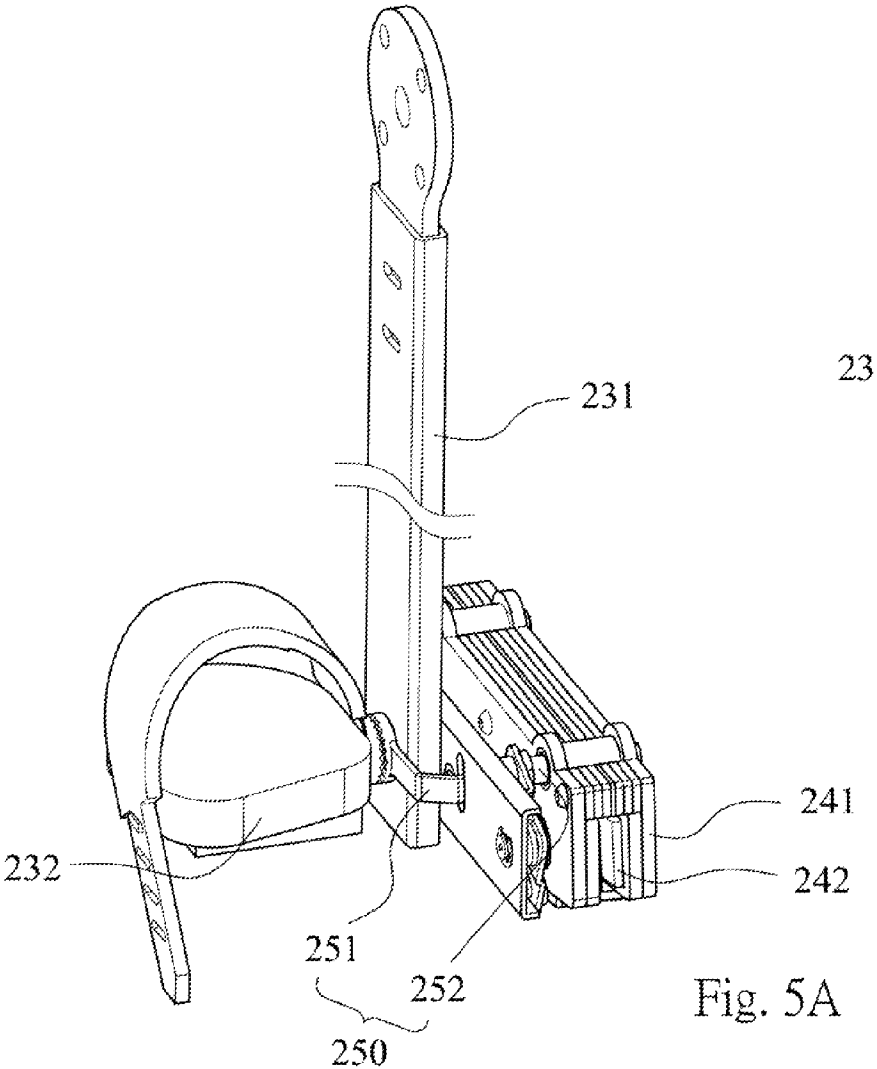
FIG. 5A is a schematic view of an adjusting device of the exercise equipment of FIG. 4.

FIG. 5A is a schematic view of an adjusting device 250 of the exercise equipment 200 of FIG. 4. FIG. 5B is a schematic view of the pedals 232 of the exercise equipment 200 of FIG. 4. In FIGS. 5A and 5B, the exercise equipment 200 further includes two adjusting devices 250 connected to each of the pedals 232 and each of the magnet bases 241 respectively (only one adjusting device 250 be illustrated in FIG. 5A). Each pedal 232 can link up with each magnet base 241 via each adjusting device 250, so that the adjacent area of the magnets 242 located on each magnet base 241 and each conductive member 243. In detail, each of the adjusting devices 250 includes a shift shaft 251 and a linking shaft 252. One end of the shift shaft 251 is connected to the pedal 232, so that the shift shaft 251 is linked up with the pedal 232. One end of the linking shaft 252 is connected to the shift shaft 251, the other end of the linking shaft 252 is connected to the magnet base 241. Therefore, the user can shift the pedal 232 for linking up the shift shaft 251, and the linking shaft 252 can also be linked up with the shift shaft 251 for moving the magnet base 241, so that the adjacent area between the magnets 242 and the conductive member 243 can be changed. Thus, the magnetic resistance can be adjusted.

Figure 6A:
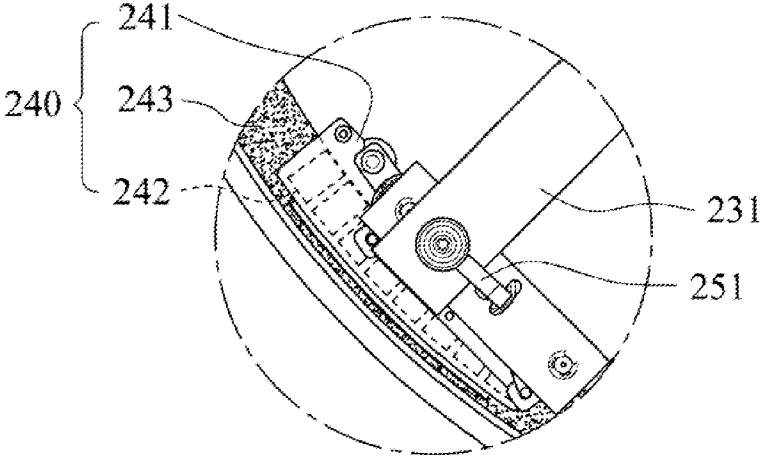
FIG. 6A is schematic views of one using states between the magnets and the conductive member of the exercise equipment of FIG. 4.
Figure 6B:
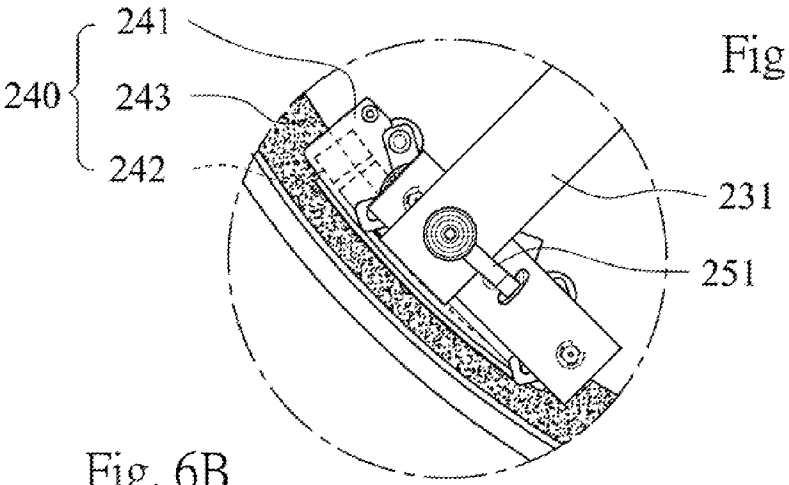
FIG. 6B is schematic views of another using states between the magnets and the conductive member of the exercise equipment of FIG. 4.
Figure 6C:
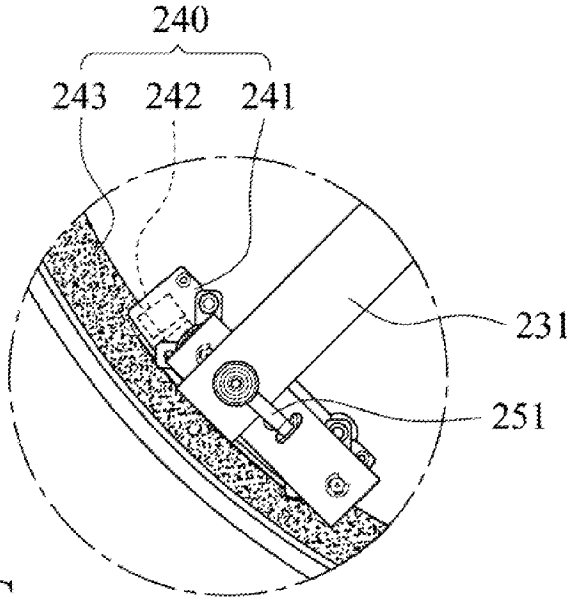
FIG. 6C is schematic views of the other using states between the magnets and the conductive member of the exercise equipment of FIG. 4.

FIGS. 6A, 6B and 6C are schematic views of three using states between the magnets 242 and the conductive member 243 of the exercise equipment 200 of FIG. 4. In FIGS. 6A, 6B and 6C, the adjacent area of the magnets 242 and the conductive members 243 can be changed by linking up the shift shaft 251 and the linking shaft 252 via the pedal 232. When the adjacent area between the magnets 242 and the conductive members 243 is changed, the generated magnetic resistance can be adjusted.

Figure 7A:
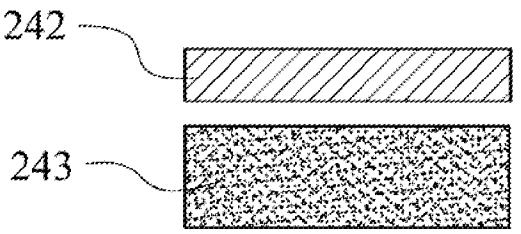
FIG. 7A shows a schematic view of the adjacent relationships between the magnet and the conductive member of one embodiment of the present disclosure.
Figure 7B:
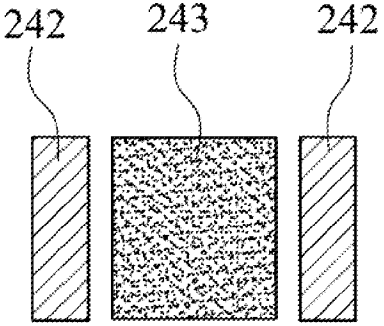
FIG. 7B shows a schematic view of the adjacent relationships between the magnet and the conductive member of another embodiment of the present disclosure.
Figure 7C:
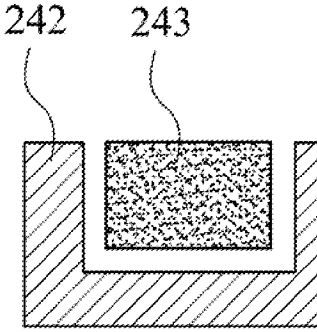
FIG. 7C shows a schematic view of the adjacent relationships between the magnet and the conductive member of yet another embodiment of the present disclosure.
Figure 7D:
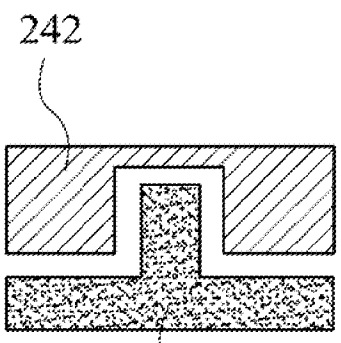
FIG. 7D shows a schematic view of the adjacent relationships between the magnet and the conductive member of still another embodiment of the present disclosure.
Figure 7E:
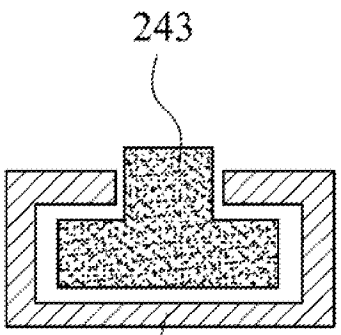
FIG. 7E shows a schematic view of the adjacent relationships between the magnet and the conductive member of further another embodiment of the present disclosure.

For generating the magnetic resistance, at least one surface of each magnet 242 and at least one surface of each conductive member 243 should be adjacent to each other. When the movement between the surface of each magnet 242 and the surface of each conductive member 243 is provided, the magnetic resistance can be generated. FIGS. 7A to 7E show schematic views of the adjacent relationships (adjacent area) between the magnet 242 and the conductive member 243 of others embodiments of the present disclosure, wherein the magnet base 241 is not shown herein. In FIG. 7A, the magnet 242 is disposed on one inner wall of the magnet base 241, and one surface of the conductive member 243 is adjacent to the magnet 242. In FIG. 7B, the magnets 242 are disposed on two inner walls of the magnet base 241, and the conductive member 243 is located between the magnets 242. That is, two surfaces of the conductive member 243 are adjacent to the magnet 242. In FIG. 7C, the magnets 242 is U-shaped, and the conductive member 243 is embedded into the magnets 242. That is, three surfaces of the conductive member 243 are adjacent to the magnet 242. In FIG. 70, the magnets 242 is U-shaped, and the conductive member 243 is T-shaped which be embedded into the magnets 242. Therefore, four surfaces of the conductive member 243 are adjacent to the magnet 242. In FIG. 7E, the magnets 242 is U-shaped, and the conductive member 243 is T-shaped which be embedded into the magnets 242. That is, five surfaces of the conductive member 243 are adjacent to the magnet 242. By such arrangements, the adjacent area between the conductive member 243 and the magnet 242 can be varied on demand, and different arrangements can provide different magnetic resistance.

Figure 8:
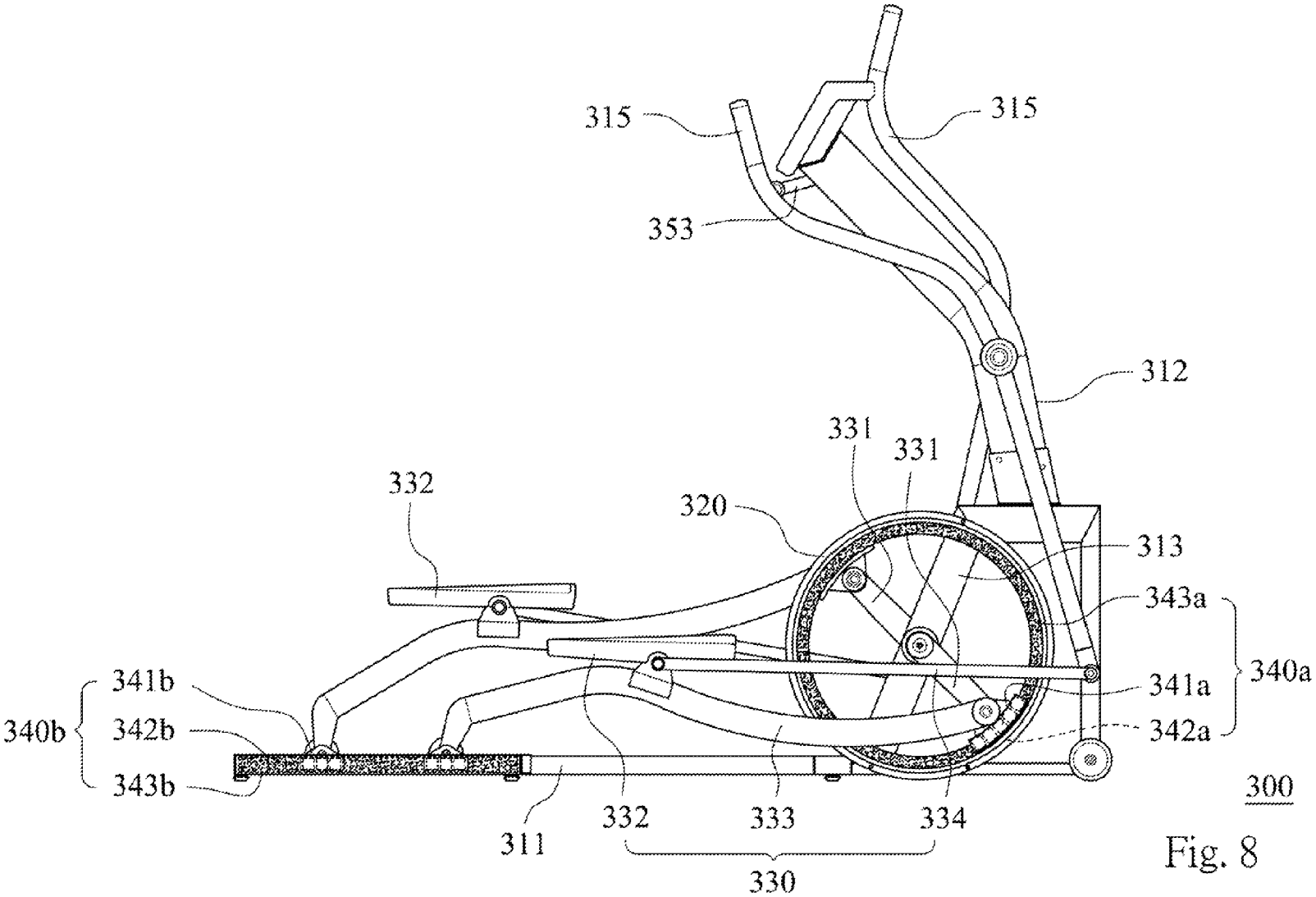
FIG. 8 shows a schematic view of an exercise equipment according to further another embodiment of the present disclosure.

FIG. 8 shows a schematic view of an exercise equipment 300 according to further another embodiment of the present disclosure. In FIG. 8, the base includes a bottom base 311, a first branch base 312 and a second branch base 313, wherein the first branch base 312 and a second branch base 313 are disposed on the bottom base 311. Two handles 315 are pivotally connected to two sides of the first branch base 312. The rails 320 are disposed on two sides of the second branch base 313 of the base. In FIG. 8, the rails 320 are circular-shaped, but is not limited thereto.

In FIG. 8, the operating device 330 includes two driving cranks 331, two pedals 332, two first linking cranks 333 and two second linking cranks 334. One end of each driving crank 331 is pivotally connected to the second branch base 313, another end of each driving crank 331 is pivotally connected to one end of each first linking crank 333, and another end of each first linking crank 333 is slidably connected to the bottom base 311. Each second linking crank 334 connects each handle 315 and each first linking crank 333, so that each handle 315 is linked up with each first linking crank 333 via each second linking crank 334. Each pedal 332 is connected to each second linking crank 334 and located on each first linking crank 333, wherein the pedals are arranged parallel to the ground.

In FIG. 8, the exercise equipment 300 includes two magnetic resistance devices, one is first magnetic resistance device 340*a*, the other is second magnetic resistance device 340*b*. The first magnetic resistance device 340*a* includes two magnet bases 341*a*, a plurality of magnets 342*a* and two conductive members 343*a*, wherein each magnet base 341*a* is connected to each driving crank 331, and each driving crank 331 is operated by each pedal 332 and each first linking crank 333 for linking up with each magnet base 341*a*. Therefore, the movement between the magnets 342*a* located on each magnet base 341*a* and each conductive member 343*a* can be provided, so that the magnetic resistance is generated.

In this embodiment, the exercise equipment 300 further includes the second magnetic resistance device 340*b*. The second magnetic resistance device 340*b* includes two magnet bases 341*b*, a plurality of magnets 342*b* and two conductive members 343*b*, wherein the conductive members 343*b* are disposed on two sides of the bottom base 311 respectively, the magnet bases 341*b* are connected to one end of each first linking crank 333 respectively and is slidably disposed on two sides of the bottom base 311 respectively. The magnets 342*b* are located on each magnet base 341*b* and are adjacent to each conductive member 343*b*. When the user step the pedals 332, the first linking cranks 333 can be moved, and two end of each first linking cranks 333 can slide along two sides of the bottom base 311. Therefore, the magnet bases 341*b* can be slid along the conductive members 343*b* located on the two sides of the bottom base 311 for providing the movement between the magnets 342*b* and the conductive members 343*b*, and the magnetic resistance is generated.

Moreover, the exercise equipment 300 in FIG. 8 can also include an adjusting device which for adjusting the magnetic resistance generated from the first magnetic resistance device 340*a*, wherein the adjusting device can be controlled via the controlling member 353 located on the first branch base 312. In this embodiment, the adjusting device is the same as the adjusting device 150 in FIG. 1, and will not describe and illustrate again.

Figure 9:
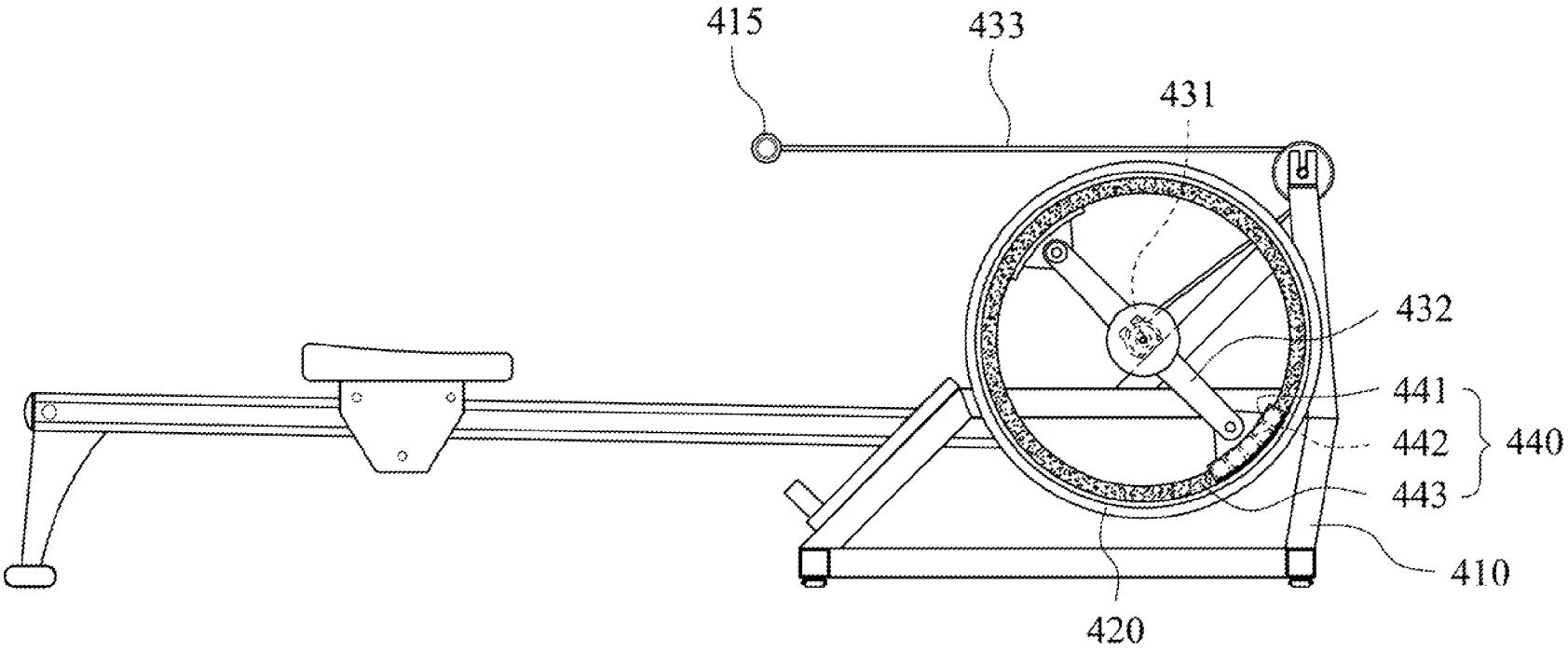
FIG. 9 shows a schematic view of an exercise equipment according to still another embodiment of the present disclosure.

FIG. 9 shows a schematic view of an exercise equipment 400 according to still another embodiment of the present disclosure, wherein the exercise equipment 400 is driven by user's hands. According to the exercise equipment 400 of FIG. 9, the operating device 430 includes a driving axis member 431, two driving cranks 431 and an operating rope 433. The driving axis member 431 is disposed on the base 410, and one end of each of the driving cranks 431 pivotally connected to the driving axis member 431. The operating rope 433 is wrapped around the driving axis member 431 and one end thereof is connected to a handle 415. Each of the magnetic resistance devices 440 includes two magnet bases 441, a plurality of magnets 442 and two conductive members 443, and are the same as the foregoing embodiment, and will not describe again herein.

When the user pulling the handle 415, the operating rope 433 can link up with the driving cranks 432, and the driving cranks 432 is pivoted along the rails 420.

Figure 10:
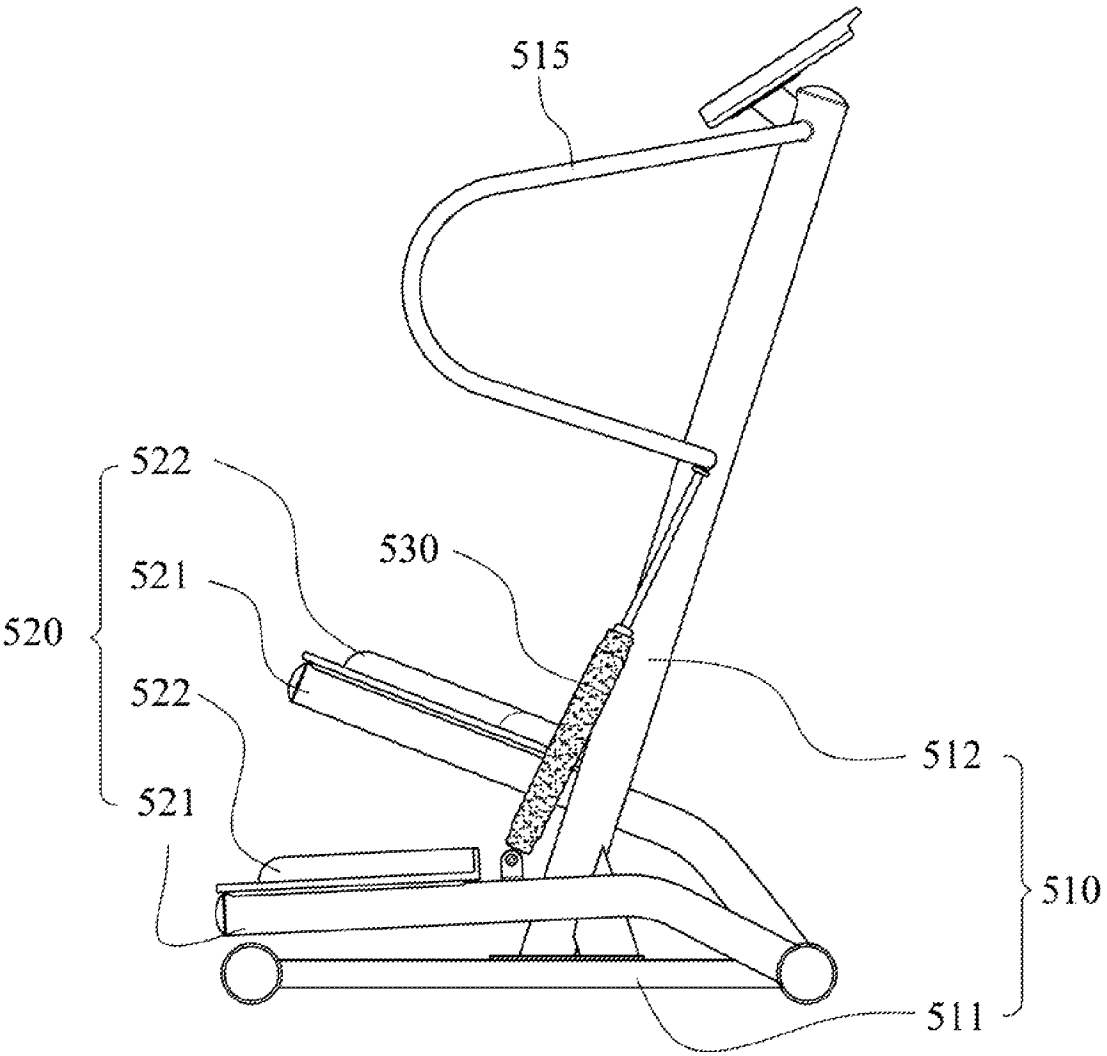
FIG. 10 shows a schematic view of an exercise equipment according to yet another embodiment of the present disclosure.

FIG. 10 shows a schematic view of an exercise equipment 500 according to yet another embodiment of the present disclosure. In FIG. 9, the exercise equipment 500 includes a base 510, an operating device 520 and a magnetic resistance device 530.

The base 510 includes a bottom base 511 and a first branch base 512. The first branch base 512 is connected to the bottom base 511. Two handles 515 are connected to two sides of the first branch base 512 respectively (only one handle 515 is shown).

The operating device 520 is movably disposed on the bottom base 511 of the base 510. In FIG. 10, the operating device 520 includes two operating members 521 and two pedals 522. One end of each of the operating members 521 is pivotally connected to the bottom base 511, each of the pedals 512 is disposed on the other side of each of the operating members 521 respectively. The pedals 512 can be stepped for driving the operating members 511 alternately.

Figure 11:
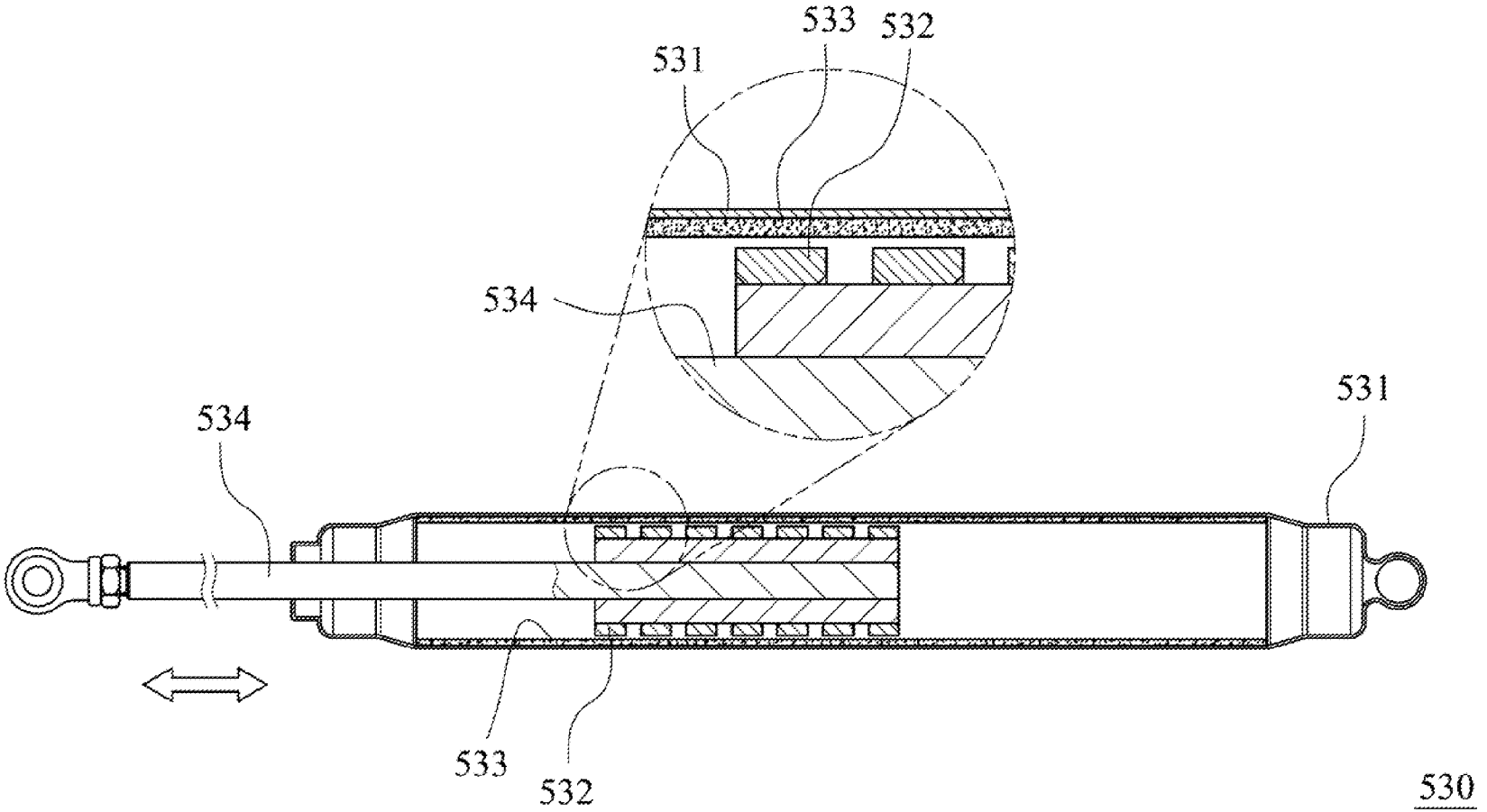
FIG. 11 shows a cross-sectional view of the magnetic resistance device of FIG. 10.

Two magnetic resistance devices 530 are connected to each of the operating members 521 of the operating device 520 and the base 510 respectively, and the following description is only one magnetic resistance device 530 is mentioned. FIG. 11 shows a cross-sectional view of the magnetic resistance device 530 of FIG. 10. The magnetic resistance device 530 includes a cylinder case 531, a magnetic resistance component assembly, and a piston rod 534, wherein the magnetic resistance component assembly includes magnets 532 and a conductive member 533. One end of the cylinder case 531 is connected to the operating member 521. The magnetic resistance component assembly is located in the cylinder case 531, wherein the conductive member 533 is connected to an inner wall of the cylinder case 531, the magnets 532 surround the piston rod 534, and the conductive member 533 is adjacent to the magnets 532. One end of the piston rod 534 is connected to the handle 515 on the first branch base 512 of the base 510, the other end of the piston rod 534 is movably surrounded by the cylinder case 531. Therefore, when the operating member 521 is alternately operated, the piston rod is pushed, so that a movement between the magnets 532 and the conductive member 533 is provided, and the magnetic resistance is generated.

Figure 12:
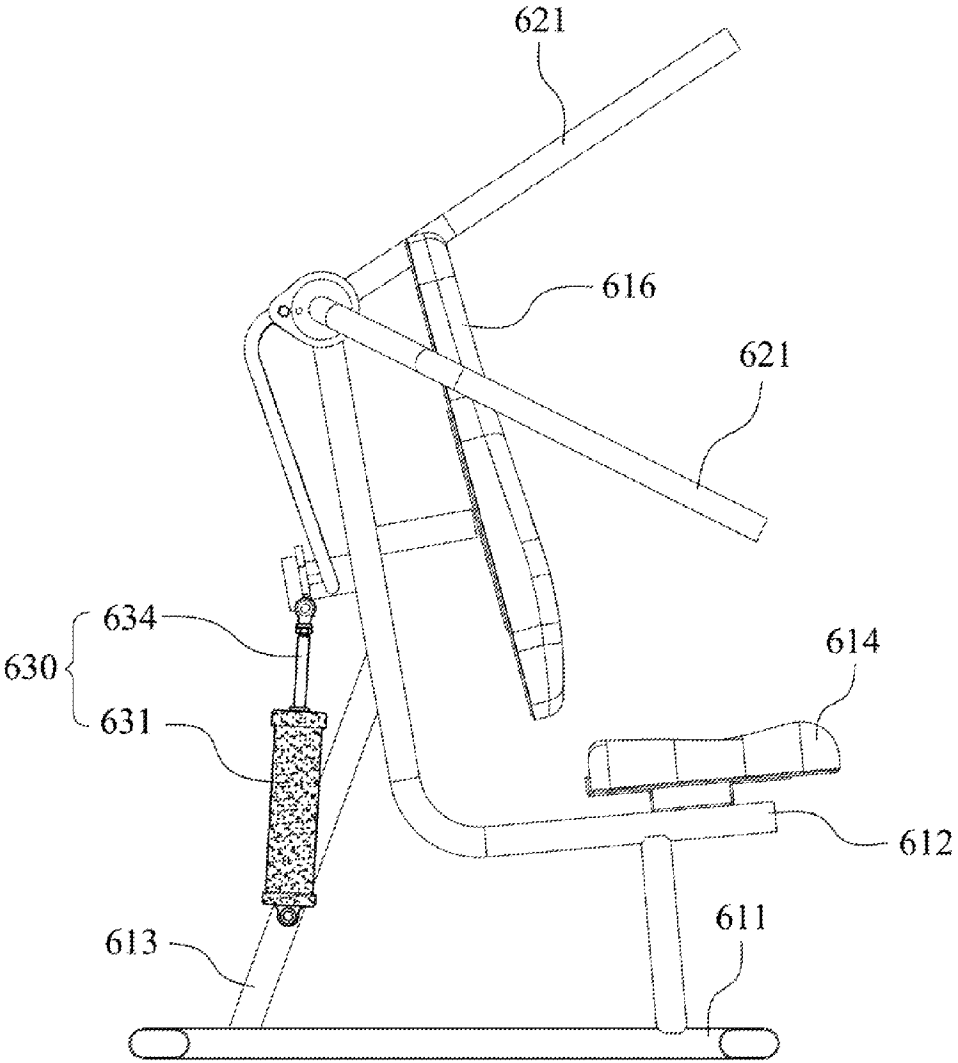
FIG. 12 shows a schematic view of an exercise equipment according to still another embodiment of the present disclosure.

FIG. 12 shows a schematic view of an exercise equipment 600 according to still another embodiment of the present disclosure. In FIG. 12, the exercise equipment 600 includes a base (not labelled), an operating device (not labelled) and a magnetic resistance device 630.

The base includes a bottom base 611, a first branch base 612, and a second branch base 613. The first branch base 612 and the second branch base 613 are disposed on the bottom base 611. The first branch base 612 is L-shaped, wherein a seat base 614 and a cushion 616 is disposed on the first branch base 612, so that the user can sit on the seat base 614, and the user's back can be supported by the cushion 616.

The operating device includes two operating members 621 which coaxially and pivotally connected to the first branch base 612 of the base. One end of the operating members 621 can be driven alternatively.

Two magnetic resistance devices 630 are connected to the other end of each of the operating members 621 of the operating device and the second branch base 613 of the base respectively, and the following description is only one magnetic resistance device 630 is mentioned. In FIG. 12, magnetic resistance device 630 includes a cylinder case 631, a magnetic resistance component assembly, and a piston rod 634, wherein the magnetic resistance component assembly includes magnets 632, a conductive member 633 and a magnet base 635 (in FIG. 13A), wherein the magnet base 635 can include a plurality of layer frames and the magnets 632 can be arranged on the layer frames. The cylinder case 631 is connected to the second branch base 613, and the outer end of the piston rod 634 is connected and linked up with the other end of the operating member 621. When the operating members 621 is driven alternatively, the piston rod 634 is linked up and the movement between the magnets 632 and the conductive member 633 is provided, so that the magnetic resistance is generated.

Figure 13A:
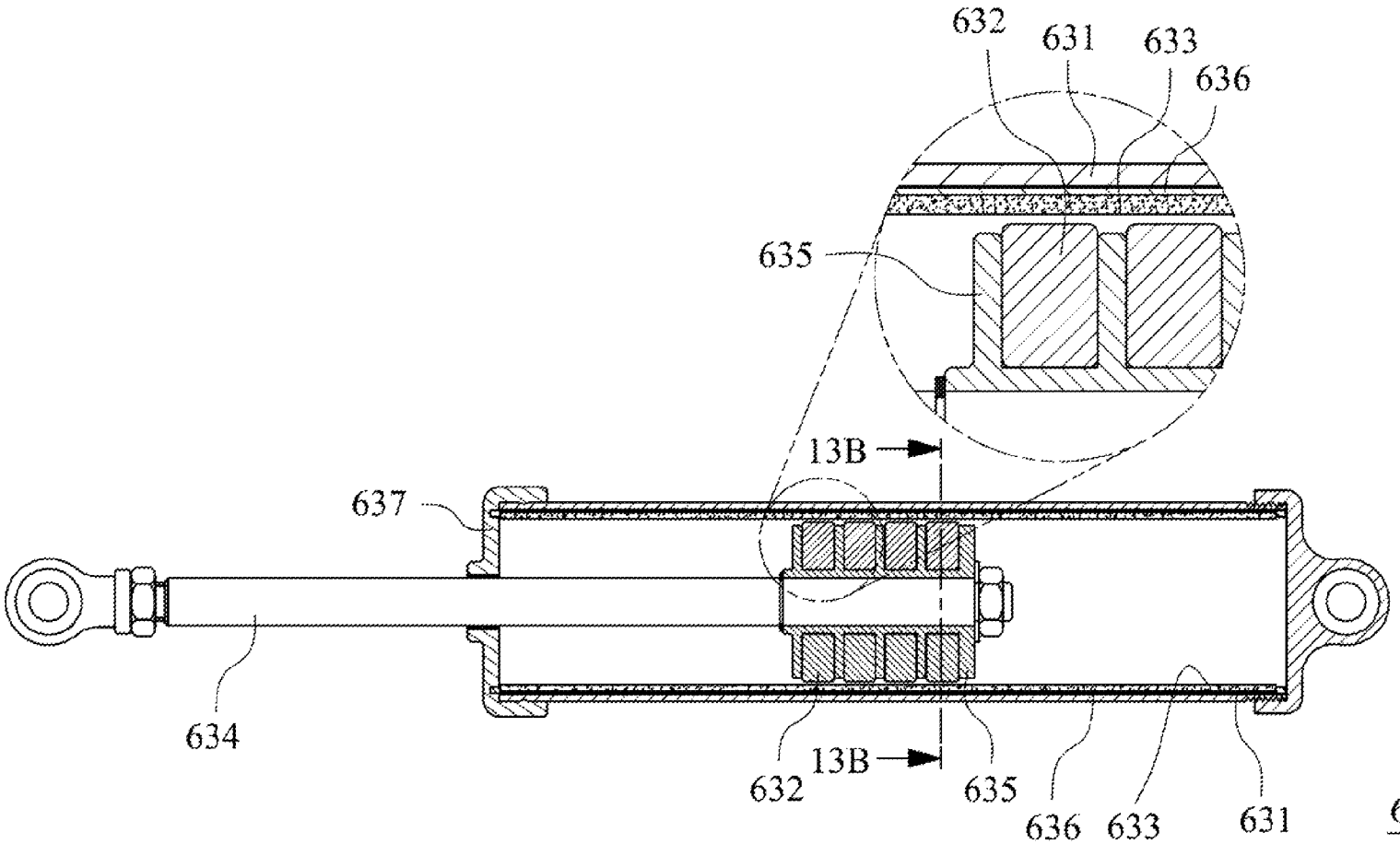
FIG. 13A shows a cross-sectional view of one magnetic resistance device and the resistance adjusting device of the exercise equipment of FIG. 12.

In order to adjust the magnetic resistance, the exercise equipment 600 further includes a resistance adjusting device (unlabeled). FIG. 13A shows a cross-sectional view of one magnetic resistance device 630 and the resistance adjusting device of the exercise equipment 600 of FIG. 12. In FIG. 13A, the resistance adjusting device includes a rotating base 636 and an adjusting cover 637. The rotating base 636 is rotatably connected to the inner wall of the cylinder case 631 and a plurality of the conductive members 633 is disposed on the rotating base 636, that is, the conductive member 633 is connected to the inner wall of the cylinder case 631 via the rotating base 636. The adjusting cover 637 is rotatably connected to the open end of the cylinder case 631, and linked up with the rotating base 636, wherein the piston rod 634 is passed through the adjusting cover 637 and inserted into the cylinder case 631. By the arrangement of the magnet base 635, the magnets 632 can be moved stably.

Figure 13B:
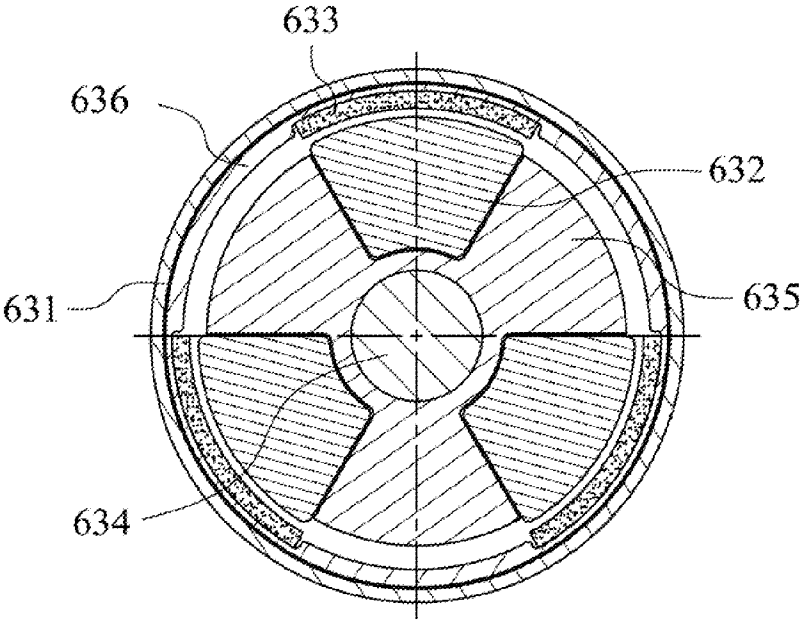
FIG. 13B shows a cross-sectional view of the magnetic resistance device and the resistance adjusting device along line 13B-13B of FIG. 13A.

FIG. 13B shows a cross-sectional view of the magnetic resistance device 630 and the resistance adjusting device along line 13B-13B of FIG. 13A. In FIG. 13B, number of the conductive members 633 is three and equally arranged on the rotating base 636. There are three magnets 632 located on each of the layer frames of the magnet base 635. When the entire side surface of each magnet 632 is faced to each conductive member 633, the magnetic resistance is largest.

Figure 13C:
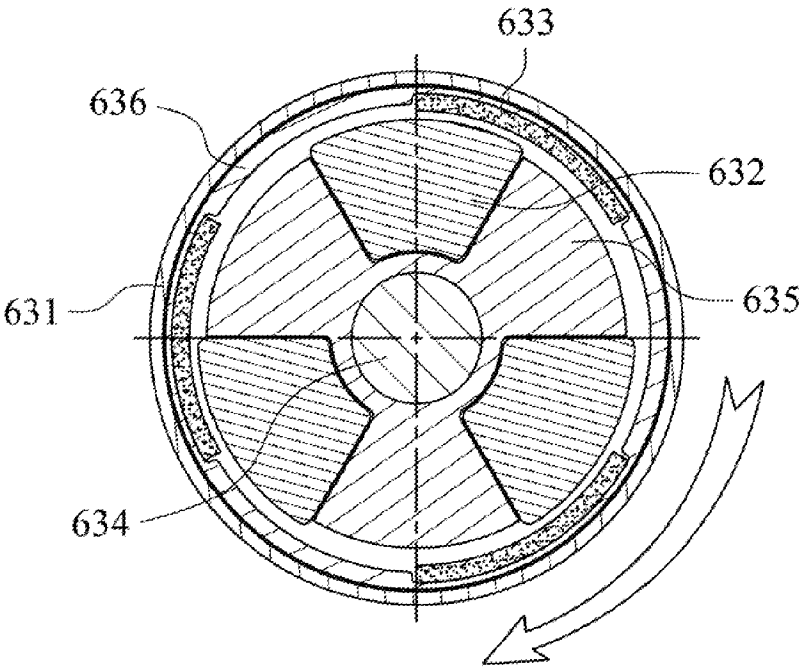
FIG. 13C shows a cross-sectional view of another state of the magnetic resistance device and the resistance adjusting device of FIG. 13B.

FIG. 13C shows a cross-sectional view of another state of the magnetic resistance device 630 and the resistance adjusting device of FIG. 13B. When the adjusting cover 637 is turned, the rotating base 636 is rotated and the conductive members 633 thereon is moved. Therefore, partial surface of each magnet 632 is not faced to each conductive member 633, thus, the magnetic resistance is smaller during the piston rod 634 is driven.

Figure 14:
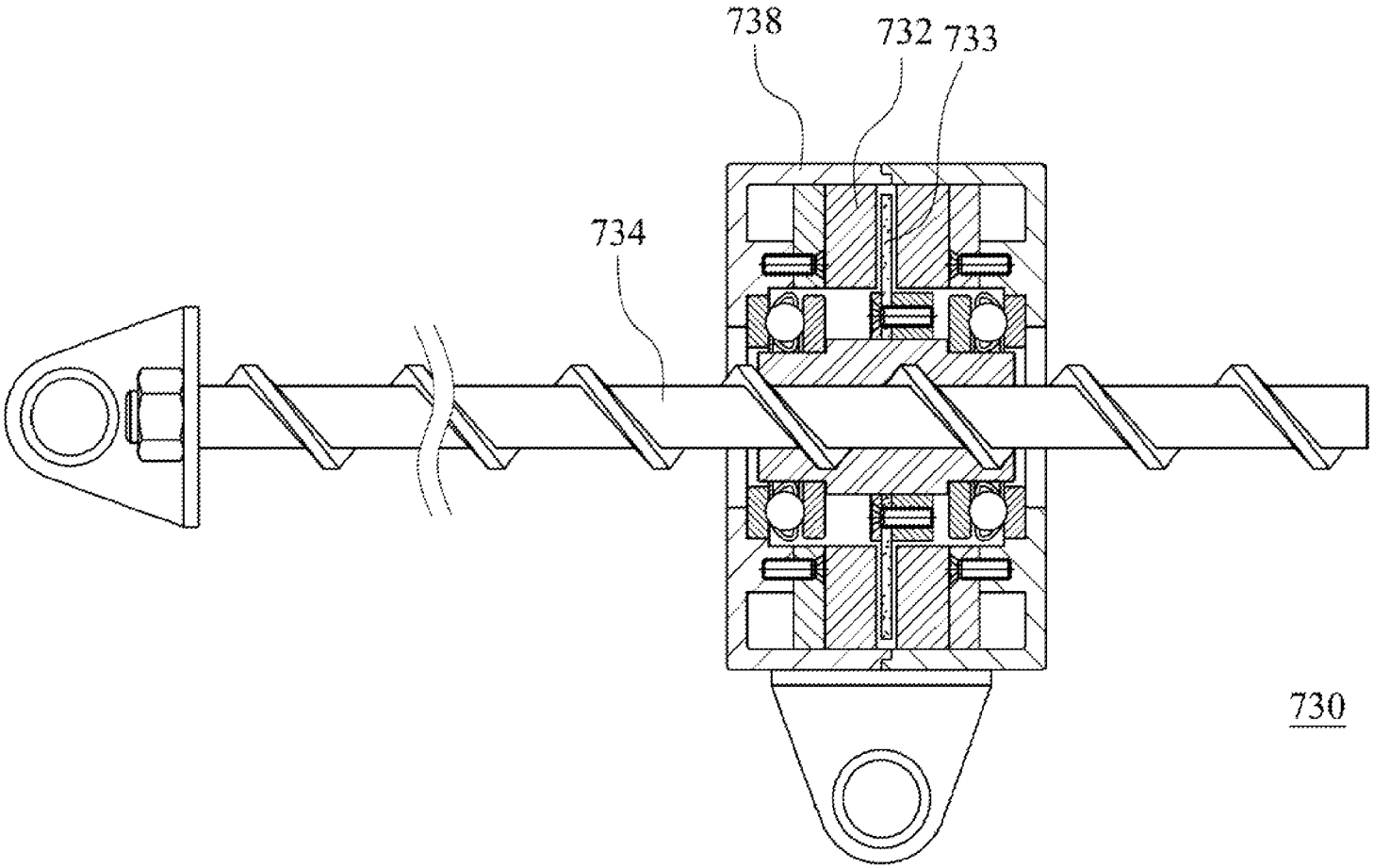
FIG. 14 show a schematic views of a magnetic resistance device of an exercise equipment according to further another embodiment of the present disclosure.

FIG. 14 show a schematic views of a magnetic resistance device 730 of an exercise equipment according to further another embodiment of the present disclosure, wherein the cylinder case of the magnetic resistance device 730 will not be shown in FIG. 14. In FIG. 14, the piston rod 734 is a screw rod. The magnetic resistance component assembly includes a plurality of magnets 732, a conductive member 733 and a magnet case 738, wherein the magnets 732 and the conductive member 733 is located in the magnet case 738. The magnets 732 is connected to two inner side of the magnet case 738, and the magnets 732 on each inner side is faced to the surface of the conductive member 733. The piston rod 734 is inserted through the conductive member 733 and the magnet case 738, wherein the conductive member 733 is linked up with the piston rod 734, so that when the piston rod 734 is moved, the conductive member 733 is rotated, and the movement between the magnet 732 and the conductive member 733 is provided. Especially, the piston rod 734 is a screw rod, so that the rotational speed of the conductive member 733 can be increased, and the magnetic resistance can also be increased.

Figure 15:
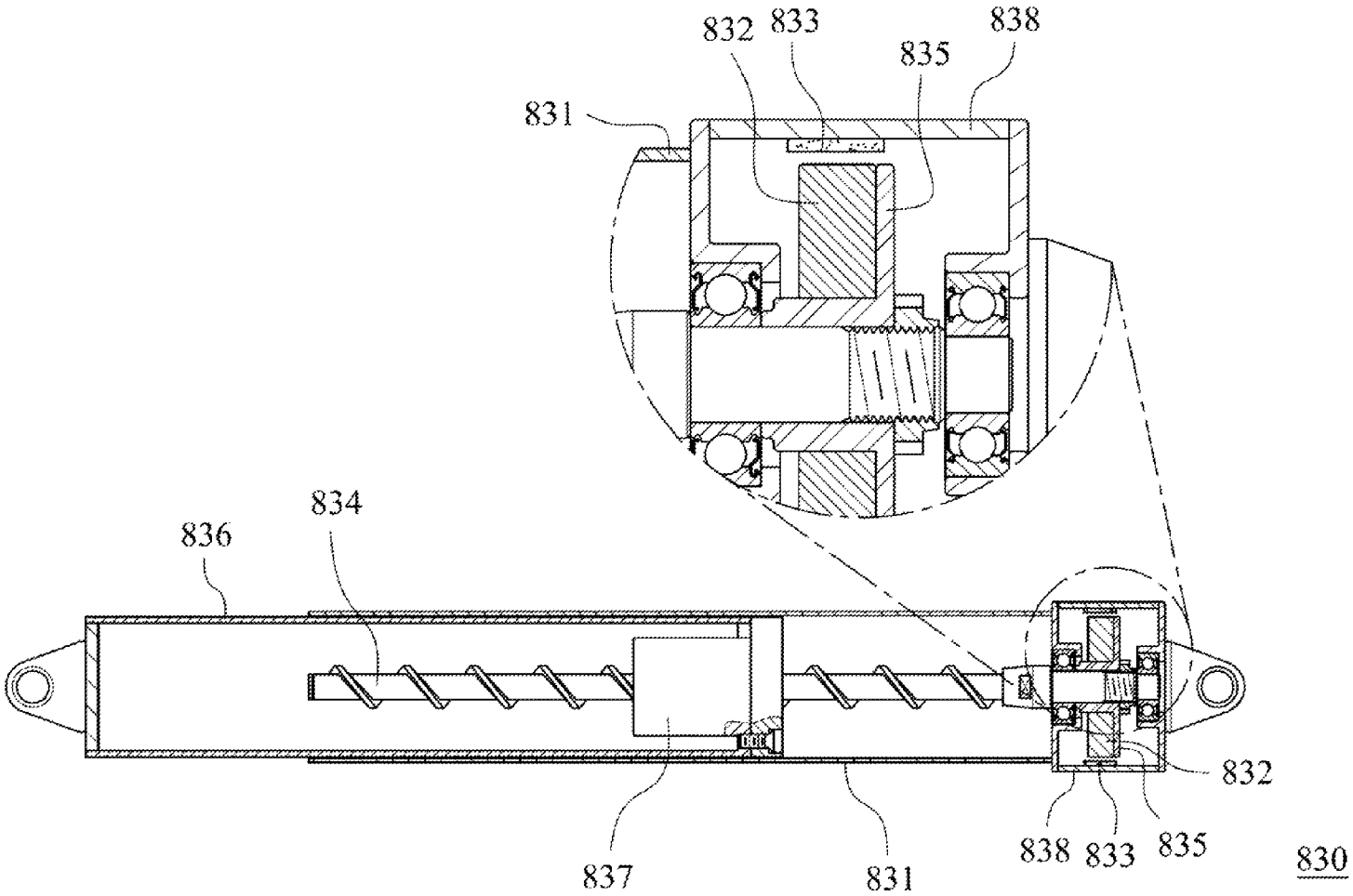
FIG. 15 show a schematic views of a magnetic resistance device of an exercise equipment according to still another embodiment of the present disclosure.

FIG. 15 show a schematic views of a magnetic resistance device 830 of an exercise equipment according to still another embodiment of the present disclosure. In FIG. 15, the magnetic resistance device 830 includes a cylinder case 831, a magnet case 838, a magnet 832, a conductive member 833, a magnet base 835, a piston rod 834, a telescopic tube 836 and a ball screw cap 837. The magnet case 838 is fixed to one end of the cylinder case 831, wherein the conductive member 833 is disposed on the inner wall of the magnet case 838, and the magnet base 835 is located in the magnet case 838 and the magnet 832 is disposed on the magnet base 835. One surface of the conductive member 833 is adjacent to one surface of the magnet 832. The piston rod 834 is a ball screw rod which is located in the cylinder case 831, wherein one end of the piston rod 834 is inserted to the magnet case 838 and connected to the magnet base 835, so that the magnet 832 on the magnet base 835 can be rotated by the piston rod 834. The telescopic tube 836 is movably inserted into the cylinder case 831. The ball screw cap 837 is located in the telescopic tube 836 and is inserted by the piston rod 834. When the telescopic tube 836 is driven, the piston rod 834 can be rotated by the ball screw cap 837, and the magnet 832 on the magnet base 835 can be linked up. Therefore, the magnetic resistance can be generated.

Figure 16:
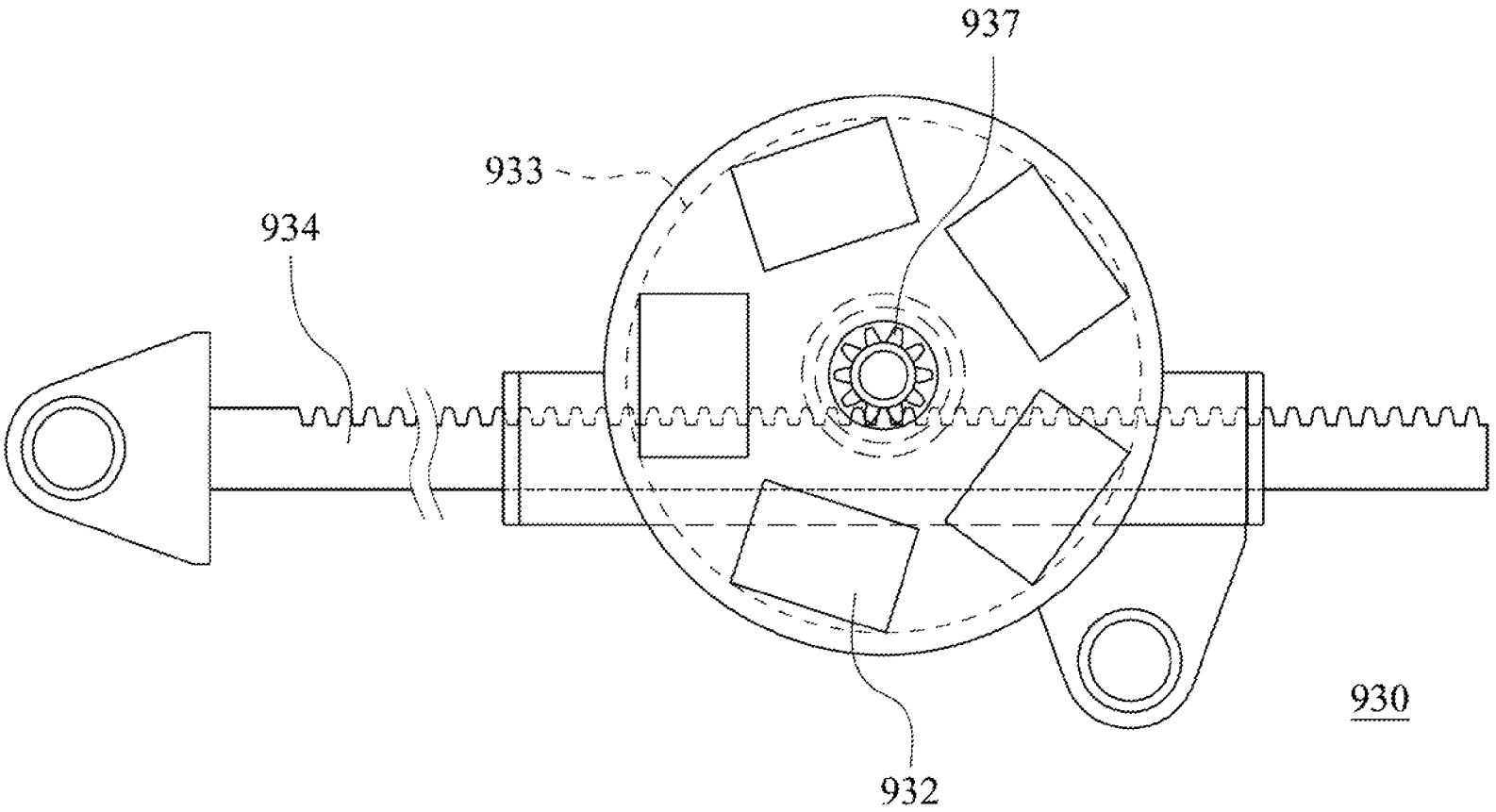
FIG. 16 shows a schematic views of a magnetic resistance device of an exercise equipment according to still another embodiment of the present disclosure.

FIG. 16 shows a schematic views of a magnetic resistance device 930 of an exercise equipment according to still another embodiment of the present disclosure. In FIG. 16, the magnetic resistance device 930 includes a cylinder case (not shown), a plurality of magnets 932, a conductive member 933, a piston rod 934 and a gear 937. The magnets 932 is disposed on the inner wall of the cylinder case, and is adjacent to two surfaces of the conductive member 933. The gear 937 is located on the center of the conductive member 933. The piston rod 934 is a gear rack, and is meshed to the gear 937. When the piston rod 934 is driven, the gear 937 can be rotated and links up with the conductive member 933. Therefore, the conductive member 933 can be rotated, and the movement between the magnet 932 and the conductive member 933 is provided for generating the magnetic resistance.

Figure 17:
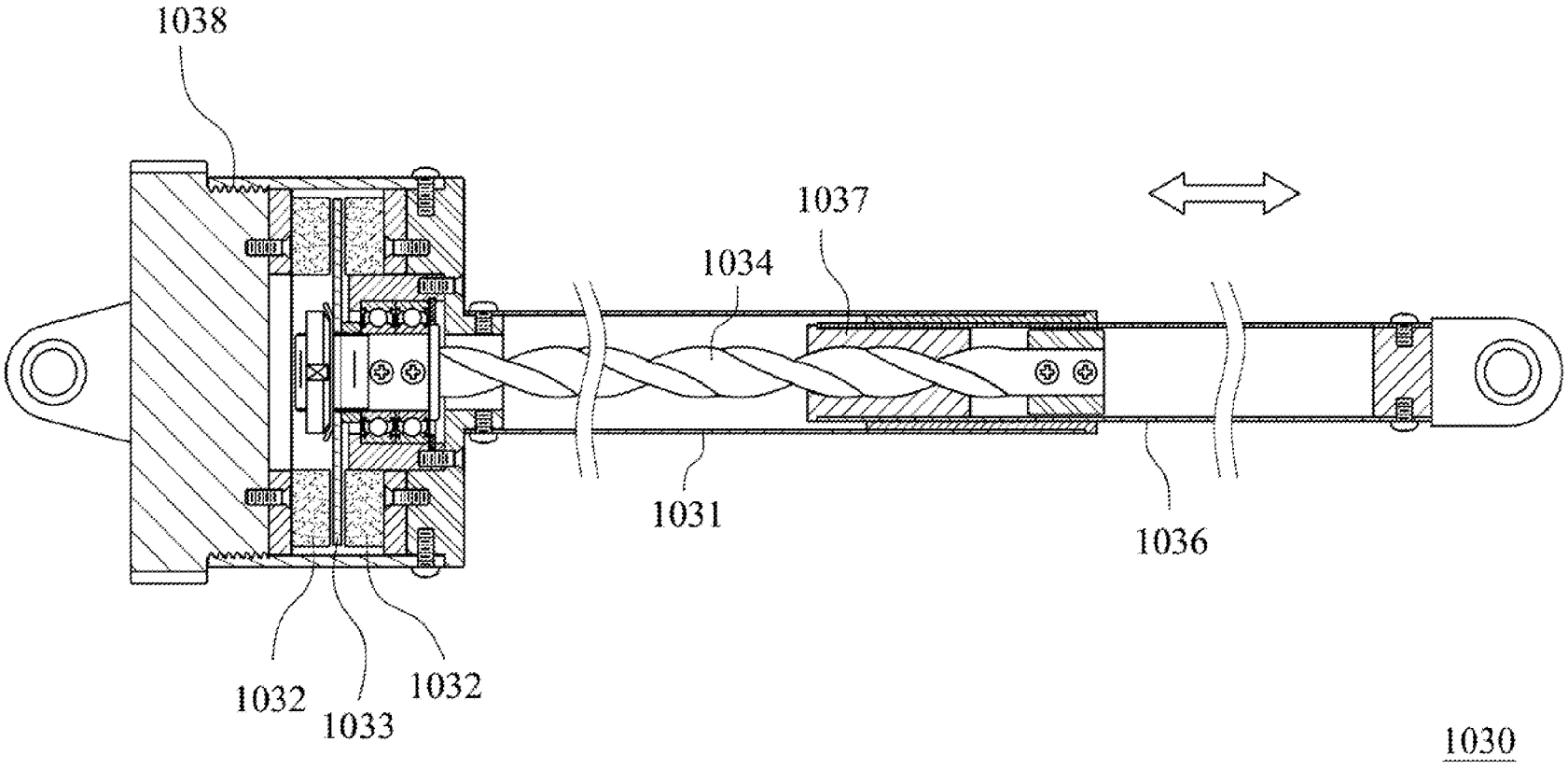
FIG. 17 show a schematic views of a magnetic resistance device of an exercise equipment according to still another embodiment of the present disclosure.

FIG. 17 show a schematic views of a magnetic resistance device 1030 of an exercise equipment according to still another embodiment of the present disclosure. In FIG. 17, the magnetic resistance device 1030 includes a cylinder case 1031, a magnet case 1038, a plurality of magnets 1032, a conductive member 1033, a piston rod 1034, a telescopic tube 1036 and a twist screw cap 1037. The magnet case 1038 is connected to the bottom base of the base of the exercise equipment (not shown) and one end of the cylinder case 1031. In the magnet case 1038, the magnets 1032 is arranged on two inner end walls of the magnet case 1038, and the magnets 1032 are adjacent to two surfaces of the conductive member 1033. The piston rod 1034 is a twist screw rod which is located in the cylinder case 1031, wherein one end of the piston rod 1034 is inserted to the magnet case 1038 and coaxially connected to the conductive member 1033, so that the conductive member 1033 can be rotated by the piston rod 1034. The twist screw cap 1037 is located in the telescopic tube 1036 and is inserted by the piston rod 1034. When the telescopic tube 1036 is driven, the piston rod 1034 can be rotated by the twist screw cap 1037, and the conductive member 1033 in the magnet case 1038 can be linked up. Therefore, the magnetic resistance can be generated.

Figure 18:
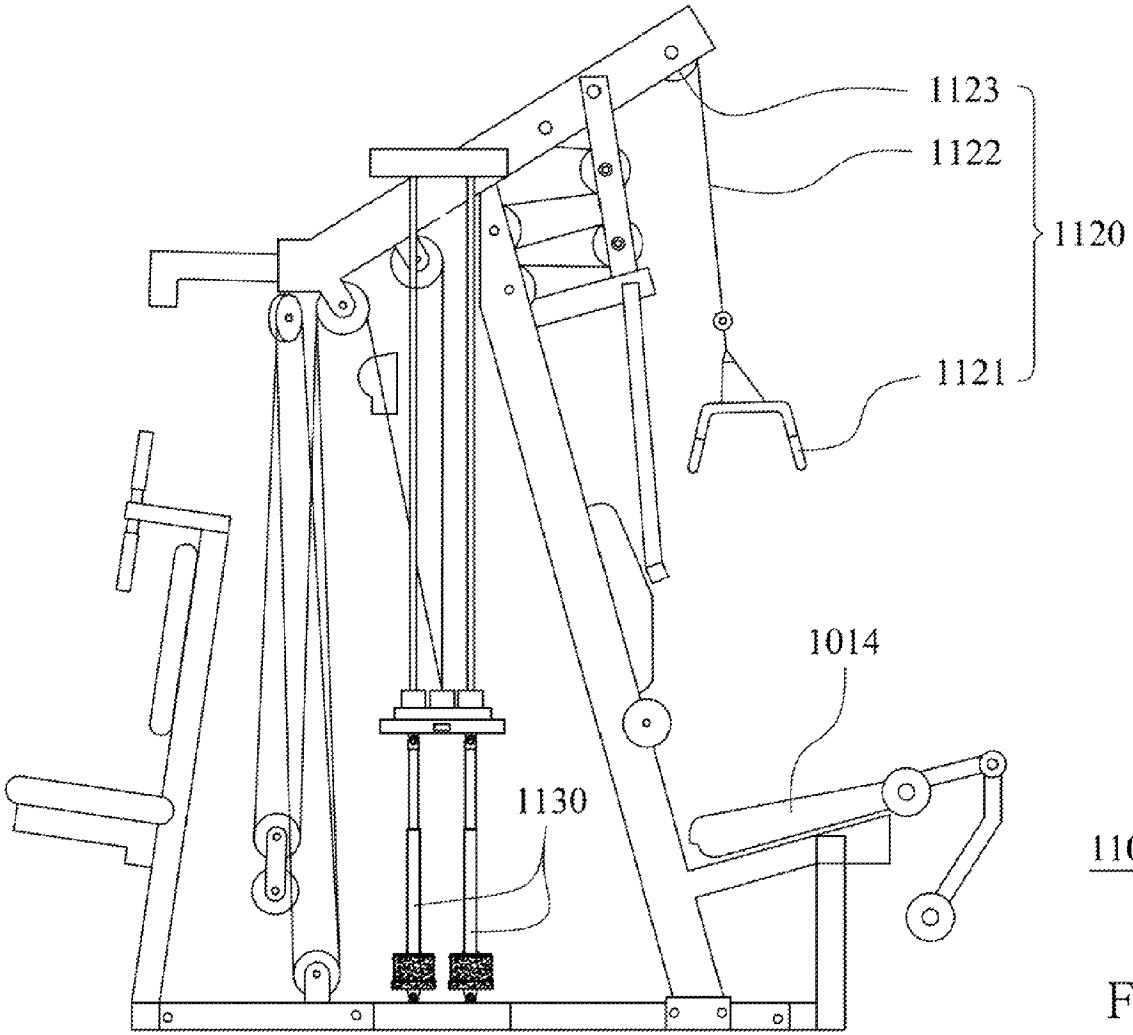
FIG. 18 shows a schematic view of an exercise equipment 1100 according to still another embodiment of the present disclosure.

FIG. 18 shows a schematic view of an exercise equipment 1100 according to still another embodiment of the present disclosure. In FIG. 18, the user can sit on the seat base 1014 and pull the operating device 1120 for driving the magnetic resistance devices 1130, so that the magnetic resistance devices 1130 can provide the magnetic resistance.

In detail, the operating device 1120 includes a handle 1121, a rope 1122 and a plurality of pulleys 1123, wherein the pulleys 1123 are pivotally connected to the base (not labelled) of the exercise equipment 1100, and the rope 1122 is wrapped through the pulleys. One end of the rope 1122 is connected to the handle 1121, and the other end of the rope 1122 is connected to the magnetic resistance devices 1130. The magnetic resistance devices 1130 is the same as any magnetic resistance devices of the foregoing embodiment of FIGS. 10-18, and will not describe again herein.

Figure 19:
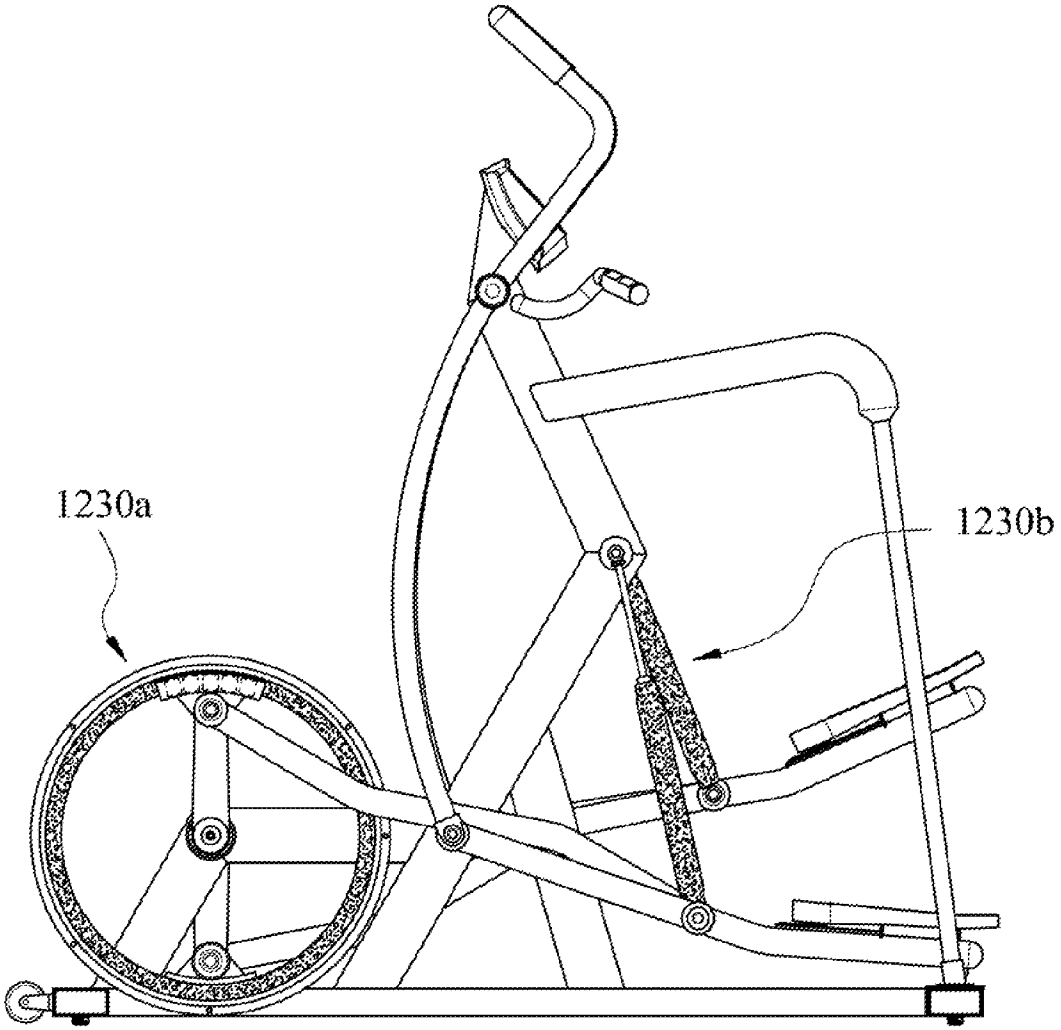
FIG. 19 shows a schematic view of an exercise equipment according to yet another embodiment of the present disclosure.

FIG. 19 shows a schematic view of an exercise equipment 1200 according to yet another embodiment of the present disclosure. In FIG. 19, the exercise equipment 1200 includes two magnetic resistance device, one is first magnetic resistance device 1230*a*, the other one is second magnetic resistance device 1230*b*. The first magnetic resistance device 1230*a* is the same as the first magnetic resistance device 340*a* of FIG. 8, and will not describe again herein. The second magnetic resistance device 1230*b* is the same as the magnetic resistance device 530 of FIG. 10, and will not describe again herein.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this invention provided they fall within the scope of the following claims.

What is claimed is:

1. An exercise equipment, comprising:

a base an operating device movably disposed on the base; and at least one magnetic resistance device connected to the operating device and the base, wherein the magnetic resistance device is for providing a magnetic resistances in accordance with an operation of the operating device, and the magnetic resistance device comprises:

a cylinder case disposed on the base;

a magnetic resistance component assembly located in the cylinder case, wherein the magnetic resistance component assembly comprises:

at least one magnet; and at least one conductive member adjacent to the magnet; and a piston rod, wherein one end of the piston rod is linked up with the operating device for providing a movement between the magnet and the conductive member, so that the magnetic resistance is generated;

wherein a relative tangential velocity of the magnet and the conductive member can be increased by the piston rod with a linear velocity, and the relative tangential velocity is greater than the linear velocity, thus the magnetic resistance is increased during the piston rod is driven.

2. The exercise equipment of claim 1, wherein the operating device comprises:

two operating members pivotally connected to the base; and two pedals disposed on the operating members respectively.

3. The exercise equipment of claim 1, wherein the piston rod is a screw rod, ball screw rod or twist screw rod.

4. The exercise equipment of claim 1, wherein the piston rod of the magnetic resistance device is a ball screw rod, and the magnetic resistance device further comprises:

a telescopic tube movably inserted into the cylinder case; and a ball screw cap located in the telescopic tube and is inserted by the piston rod for rotating the piston rod.

5. The exercise equipment of claim 1, wherein the piston rod is a gear rack, and the magnetic resistance device further comprises.

a gear, wherein the gear is rotated by the piston rod and links up with the conductive member.

6. The exercise equipment of claim 1, wherein the piston rod of the magnetic resistance device is a twist screw rod, and the magnetic resistance device further comprises:

a telescopic tube movably inserted into the cylinder case; and a twist screw cap located in the telescopic tube and is inserted by the piston rod for rotating he piston rod.

7. The exercise equipment of claim 1, wherein the conductive member is made of copper, silver, aluminum or steel.

* * * * *